US007600475B1

(12) United States Patent
Friedberg et al.

(10) Patent No.: US 7,600,475 B1
(45) Date of Patent: Oct. 13, 2009

(54) MULTI-MODE FUZE

(75) Inventors: Jason Friedberg, Dingmans Ferry, PA (US); Olivier T. Nguyen, Somerville, NJ (US); Barry Schwartz, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 435 days.

(21) Appl. No.: 11/421,229

(22) Filed: May 31, 2006

Related U.S. Application Data

(63) Continuation-in-part of application No. 11/398,731, filed on Mar. 31, 2006, now abandoned.

(60) Provisional application No. 60/594,356, filed on Mar. 31, 2005.

(51) Int. Cl.
*F42C 9/14* (2006.01)
*F42C 11/06* (2006.01)
*F42C 17/04* (2006.01)

(52) U.S. Cl. ..... 102/265; 102/266; 102/215; 89/6.5

(58) Field of Classification Search ..... 102/265, 102/266, 270, 271, 206, 215, 216, 221, 267, 102/473, 499; 89/6, 6.5
See application file for complete search history.

(56) References Cited

U.S. PATENT DOCUMENTS 5,343,795 A * 9/1994 Ziemba et al. ..... 89/6.5
5,894,102 A * 4/1999 Oberlin et al. ..... 89/6.5
5,942,714 A * 8/1999 Oberlin et al. ..... 89/6.5
6,823,767 B2 * 11/2004 Vornfett et al. ..... 89/6.5

* cited by examiner

*Primary Examiner*—James S Bergin
(74) *Attorney, Agent, or Firm*—Henry S. Goldfine

(57) ABSTRACT

A multi-mode fuze includes first and second microprocessors, the first microprocessor being connected to a resistor/capacitor oscillator and the second microprocessor being connected to a quartz crystal oscillator, the first and second microprocessors being connected to each other, the second microprocessor being operable to time calibrate the first microprocessor; a safe and arm device connected to the first microprocessor; power storage capacitors connected to the first microprocessor; a nose mounted impact switch connected to the first microprocessor; at least one impact delay circuit connected to the first microprocessor; and at least one acceleration switch connected to the first microprocessor.

15 Claims, 7 Drawing Sheets

MULTI-MODE FUZE

CROSS-REFERENCE TO RELATED APPLICATIONS

This application is a continuation-in-part of prior application Ser. No. 11/398,731 filed on Mar. 31, 2006, which claims the benefit under 35 USC 119(e) of U.S. provisional patent application No. 60/594,356 filed on Mar. 31, 2005.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to a munition fuze having multiple functions.

Projectile fuzes of today are required to meet stringent safety design requirements. These requirements include keeping sensitive primary explosives separate from the warhead until two different launch environments are sensed. These environments must each operate separate locks in the safety and arming (S&A) mechanism. Fuzes must also maintain the safety of the gun crew by delaying arming until the projectile is a safe distance from the gun.

There are a variety of different fuzes in production. Most fuzes are single purpose and include time fuzes, proximity fuzes, impact fuzes and impact delay fuzes. Several newer fuzes are so called multi-option fuzes, which accomplish a number of these tasks. These fuzes are generally electromechanical and integrate digital electronic circuitry with mechanical S&A's. The digital circuitry is used for time and proximity functions, while impact is generally done with simple analog circuitry. Delay after impact, if done at all, is a single, fixed delay. Fuzes used in relatively low launch acceleration environments such as mortars and artillery utilize quartz crystal oscillator clocked electronics. Quartz oscillators, however, are too delicate to reliably survive the high launch acceleration of tank gun and small caliber ammunition. For these higher launch acceleration environments, resistor capacitor (RC) clocked electronics are used.

The shortcoming of RC clocked circuitry is that RC frequencies vary greatly. They vary unit to unit, they vary with time, and they vary with temperature. To make an RC clocked circuit work accurately enough to be used in a time mode, the RC must be calibrated. This calibration is done at the time of setting, via a two-way data link with a quartz-clocked setter. While this is a valid technique, it can be too time consuming for certain situations.

For example, the current tank ammunition suite includes different rounds for different target types. Tanks travel with one round in chamber to rapidly attack an enemy vehicle. In such close combat encounters the first to shoot is usually the victor. Currently tanks must travel with a round chambered, which addresses the most likely or most threatening target, usually an armored target. However, if the target is not an armored target, then, for maximum effectiveness, the tank round must be changed to correspond to the new target.

SUMMARY OF THE INVENTION

It is an object of the invention to provide a multi-mode fuze for a multi-purpose round wherein the fuze may be set in the bore of the gun.

It is another object of the invention to provide a multi-mode fuze having both quartz crystal and RC oscillators.

It is a further object of the invention to provide a multi-mode fuze wherein the quartz crystal oscillator calibrates the RC oscillator prior to launch.

Yet another object of the invention is to provide a multi-mode fuze that includes an impact function, a delayed impact function and an airburst function.

One aspect of the invention is a fuze comprising first and second microprocessors, the first microprocessor being connected to a resistor/capacitor oscillator and the second microprocessor being connected to a quartz crystal oscillator, the first and second microprocessors being connected to each other, the second microprocessor being operable to time calibrate the first microprocessor.

The fuze may further comprise a safe and arm device connected to the first microprocessor; power storage capacitors connected to the first microprocessor; a multiplexer connected to the first microprocessor; a nose mounted impact switch connected to the multiplexer; at least one impact delay circuit connected to the first microprocessor and the multiplexer; and at least one acceleration switch connected to the first microprocessor.

Preferably, the first microprocessor is settable in a plurality of modes comprising an impact mode, an airburst mode and at least one impact delay mode.

Another aspect of the invention is a projectile having a nose end, a rear end and a fuze as described above disposed in the rear end.

A further aspect of the invention is a munition having a gun tube, a setter box, and a projectile as described above disposed in the gun tube wherein the setter box is operable to electrically connect to the fuze.

Yet another aspect of the invention is a method comprising providing a munition as described above; and, prior to launch, calibrating the resistance/capacitor oscillator using the quartz crystal oscillator.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention includes a multi-mode fuze that is settable in the bore of a gun. The fuze is applicable to multiple calibers of projectiles and is completely scalable. The fuze enables a single projectile to have several selectable modes of detonation. The multi-mode fuze and multi-purpose round enable a gunner to rapidly attack a variety of targets, increasing the likelihood of a victorious result. Upon identifying the target, the vehicle fire control aims the weapon, sets the fuze and fires, all in rapid sequence. The gunner does not need to worry about what round he has loaded or what target he is attacking. He just sets the mode and fires.

The inventive fuze is electromechanical and incorporates both quartz crystal and RC oscillators in a single electronics package. The two oscillators are used to clock two separate integrated circuits (IC's). The crystal clocked IC is used to calibrate the RC clocked IC. The crystal clocked IC is used for communication with the setter box and sets the function mode and time onto the RC clocked oscillator. The crystal clocked IC, having no further role in fuze function, is turned off prior to gun launch. Because the crystal clocked IC is off during gun launch and flight, whether or not the crystal survives gun launch is irrelevant. Also, because the calibration is done internally to the electronics package, no setting time is wasted calibrating the RC timer. The entire charge and setting of the fuze may be done in only 50 milliseconds.

The inventive fuze provides the accuracy and rapid set time of a crystal oscillator with the ruggedness of an RC timer. The impact delay time and airburst time are set while the projectile and fuze are in the bore of the gun tube. The fuze is set while in the tube by the vehicle fire control. The gunner sets the function mode and time based on the expected target. The gunner can program an air burst to attack troops in the open or aerial targets. The gunner can also set a variety of impact delays to attack hard targets based on target and desired target effect. For example, if the projectile is fired at a masonry building, the fuze could be set for a short delay to create a large hole in the wall for breaching, or could be set for a longer delay to incapacitate the troops inside.

The arm command to the safety and arming device is controlled by the microprocessor.

This technique provides for gun crew safety, while maximizing the projectile's functional range. The explosive train incorporates an M100 electric detonator that is hardwired into the electronics. An M61 stab detonator in the rotor is used to transfer the explosive propagation from the M100 to the output lead charge. This provides an explosive train with no moving contacts. Moving detonator contacts can open on target deceleration and are best avoided on a fuze intended to function during target impact.

Figure 1:
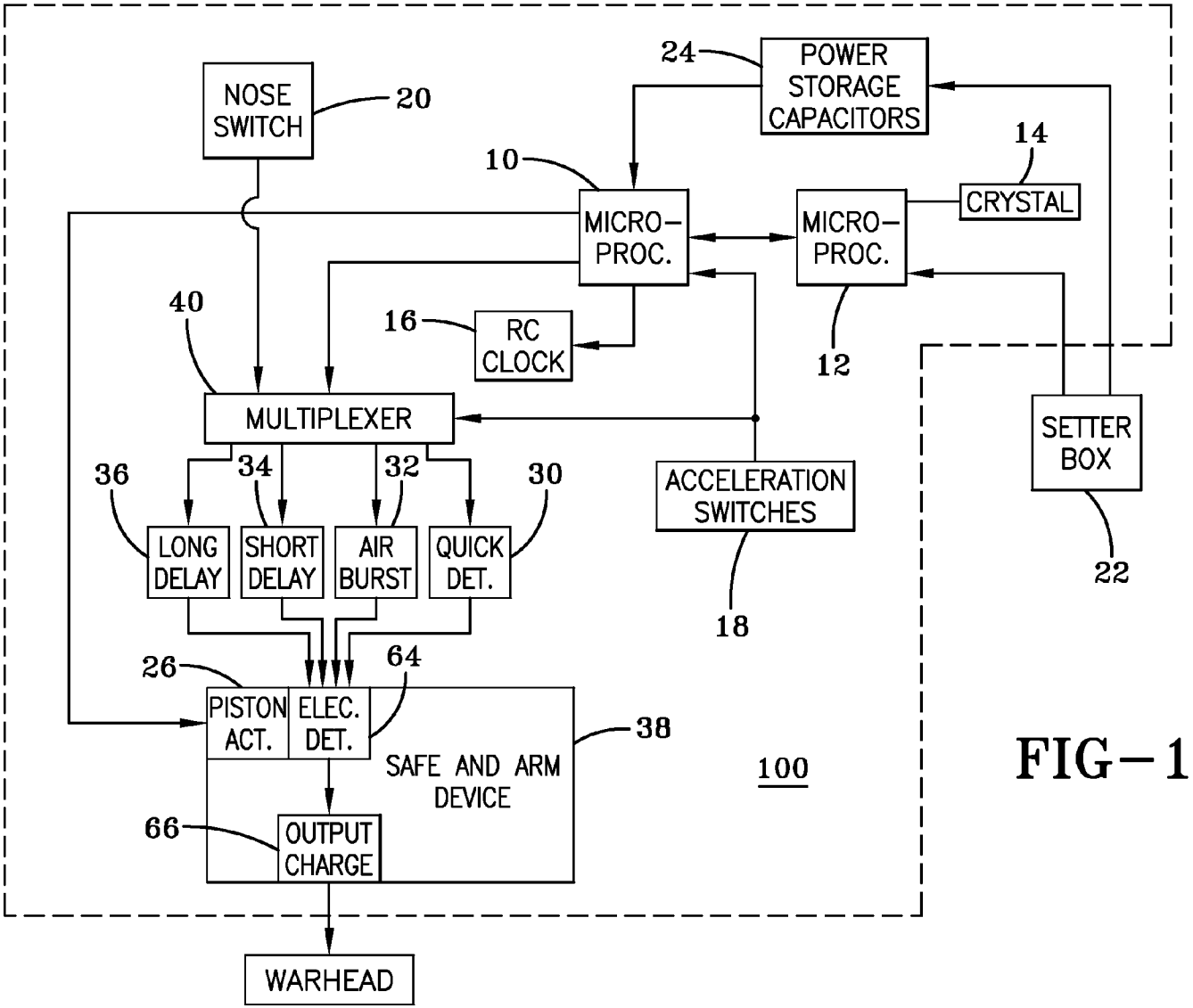
FIG. 1 is a block diagram of one embodiment of a fuze in accordance with the invention.

FIG. 1 is a block diagram of one embodiment of a fuze 100 in accordance with the invention. The fuze 100 comprises first and second microprocessors 10, 12. The first microprocessor 10 is connected to a resistor/capacitor (RC) oscillator 16 and the second microprocessor 12 is connected to a quartz crystal oscillator 14. The first and second microprocessors 10, 12 are connected to each other. The fuze 100 is able to obtain the advantages of both the RC oscillator 16 and the crystal oscillator 14 by having the second microprocessor 12 (with the crystal oscillator) time calibrate the first microprocessor 10 (with the RC oscillator) prior to launch. Then, the second microprocessor 12 is shut down and the first microprocessor 10 performs the fuzing functions during flight.

Power to the microprocessors 10, 12 is supplied by capacitors 24. The projectile containing the fuze is loaded in a gun tube for firing. The gun's fire control includes a setter box 22 that electrically connects to the fuze through the projectile base, in a known manner. The setter box 22 charges the power storage capacitors 24 and transfers the fuze mode and timing information to the second microprocessor 12. The second microprocessor 12 transfers the fuze mode and timing information to the first microprocessor 10.

The first microprocessor 10 is connected to a safe and arm device 38. The safe and arm device 38 includes two locks. The first lock is unlocked by the setback acceleration at launch and the second lock is unlocked by actuation of a piston actuator 26. The piston actuator 26 functions on command of the first microprocessor 10 after a suitable time delay. The time delay is measured from launch with time zero determined by the acceleration switches 18. At least one and preferably two acceleration switches 18 are provided. The two functions of the acceleration switches 18 are: 1) determine time zero for the time delays of the piston actuation and airburst detonation, and 2) function as impact switches for decelerations that are not large enough to close the nose switch.

The nose mounted impact switch 20, at least one impact delay circuit 34, 36 and at least one acceleration switch 18 are all connected to the multiplexer 40. The impact delay circuits 34, 36 delay detonation after an impact is sensed by either the nose switch 20 or the acceleration switches 18. Preferably, one impact delay is short and the other impact delay is long. There may be more than two impact delay circuits, if desired. Typically, the impact delay circuits are resistor/capacitor circuits.

The first microprocessor 10 is settable in a plurality of modes including, but not limited to an impact mode, an airburst mode and at least one impact delay mode. For each mode, the multiplexer 40 sends a fire signal to a detonator 64 in the safe and arm device 38. If the airburst mode is chosen, an airburst time is also chosen. When the chosen airburst time has elapsed, the multiplexer 40 sends the fire signal to detonator 64. In the impact mode, which is a quick detonation mode, one of two events may occur. When deceleration due to impact is large enough to close the nose switch 20, then the multiplexer 40 sends a fire signal to the detonator 64. When deceleration due to impact is not large enough to close the nose switch 20, but does reach a preset value, the acceleration switches 18 sense the deceleration and the multiplexer 40 sends a fire signal to the detonator 64. Small impact decelerations may be due to the projectile hitting a surface at an oblique angle. In the impact delay mode, the operation is similar to the impact mode, except the fire signal is delayed by one or more of the impact delay circuits 34, 36.

Figure 2:
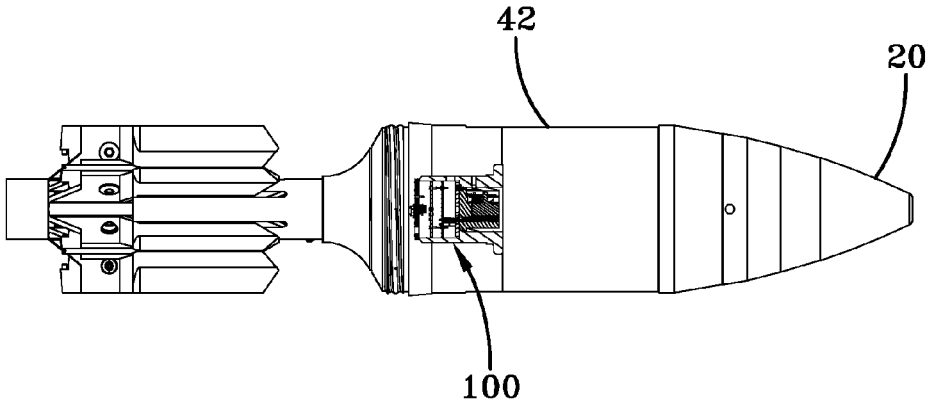
FIG. 2 schematically shows a projectile.
Figure 3:
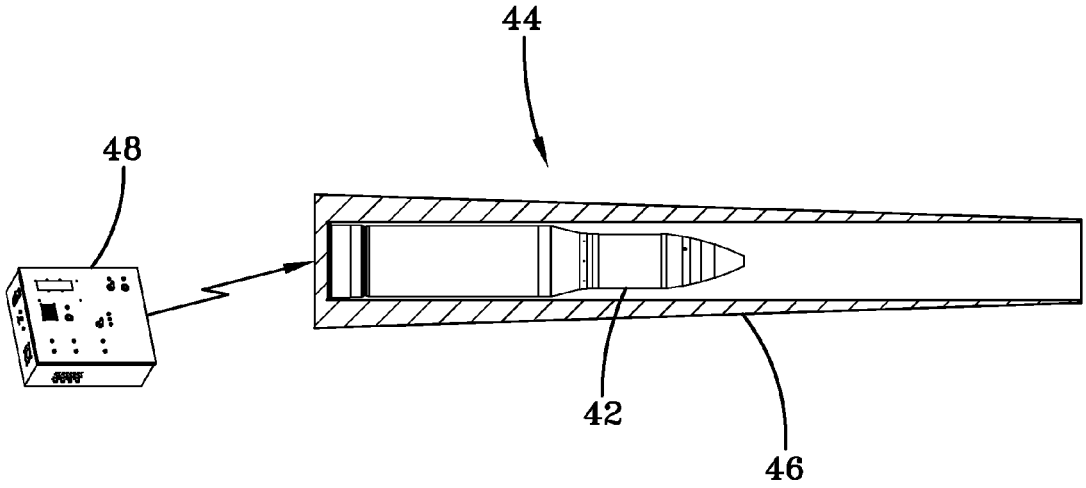
FIG. 3 schematically shows a munition.

FIG. 2 shows an exemplary projectile 42 having a nose end and a rear end. The nose mounted impact switch 20 is disposed in the nose end and all other components of the fuze 100 are disposed in the rear end of the projectile 42. FIG. 3 schematically shows a munition 44. Munition 44 includes a gun tube 46 with a projectile 42 loaded therein and a setter box 48 that may be part of the fire control apparatus for the munition 44. The setter box 48 establishes a hard electrical connection to the projectile 42 and fuze 100, in a known manner, such as through a primer diode. Through this hard electrical connection, the power supply capacitors 24 are charged and firing information is transferred from the setter box 48 to the second microprocessor 12.

The firing information comprises a mode selection, i.e, airburst, impact or impact delay, and an appropriate time period. For example, in the airburst mode the selectable time period is the time from launch to detonation. In the impact mode, no time period is needed because the fuze detonates on impact. In the impact delay mode, the selectable time period is the time period from impact to detonation. The time period from launch to firing of the piston actuator 26 is generally fixed and not a part of the fire control solution.

Figure 4:
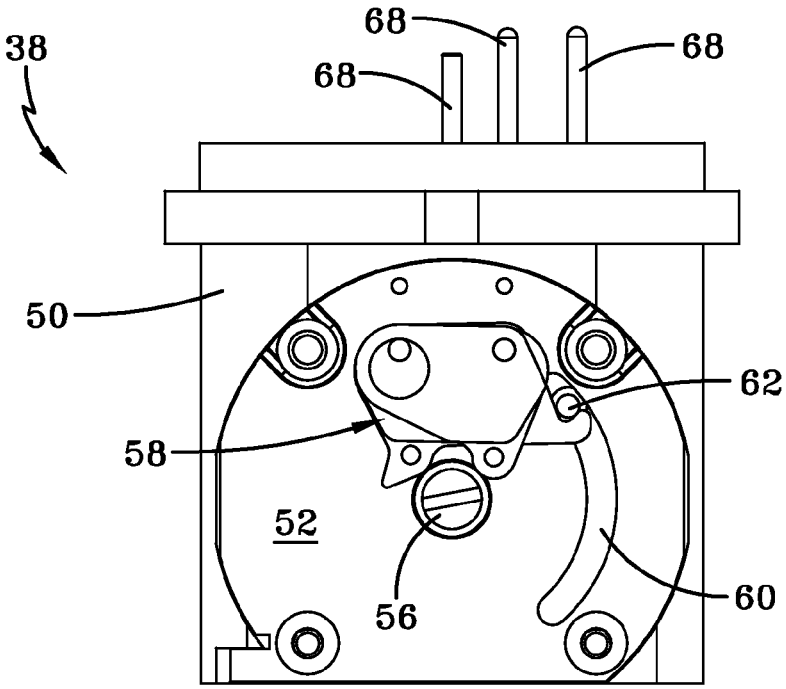
FIGS. 4 and 5 are schematic cutaways of the safe and arm device.
Figure 7A:
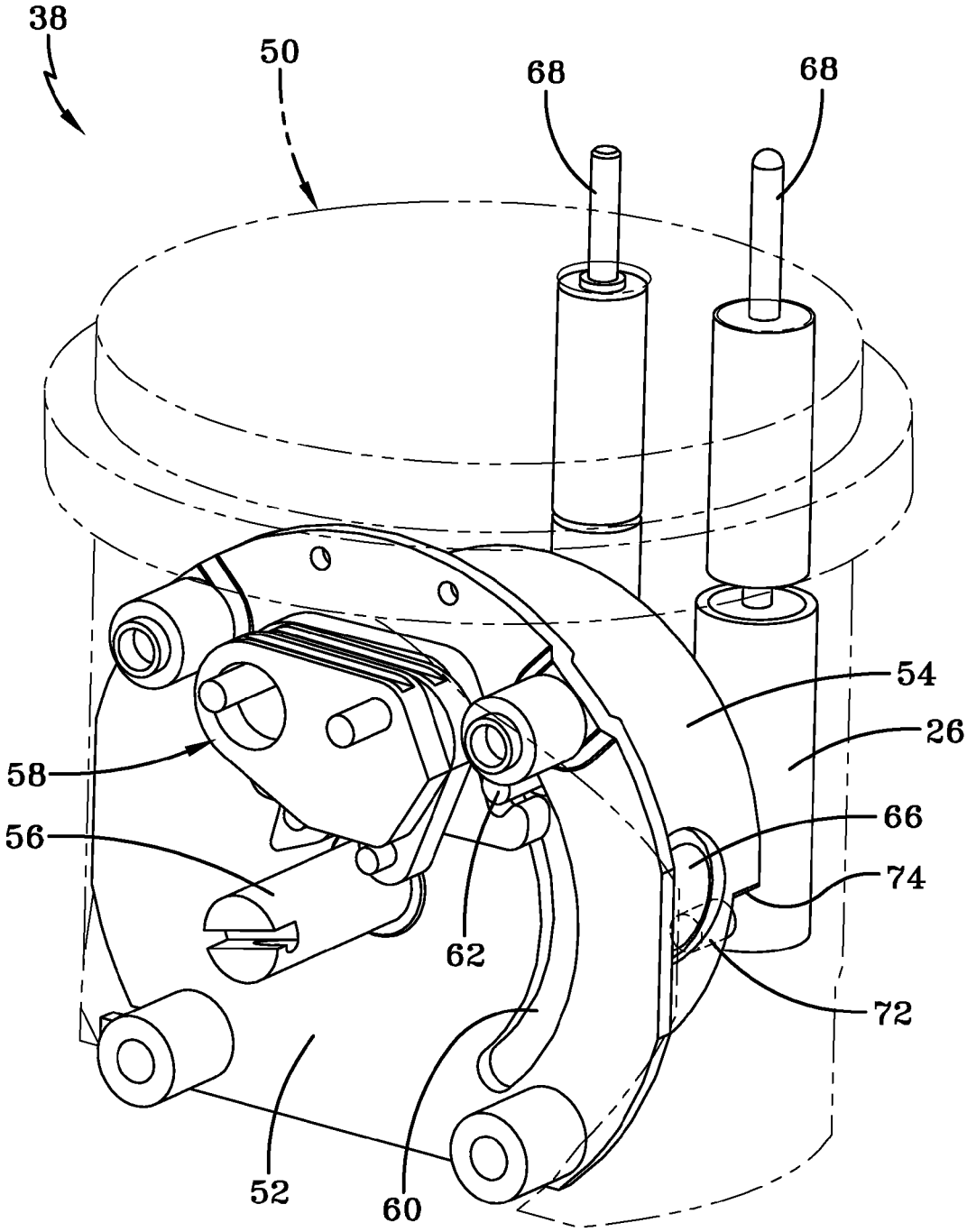
FIGS. 7A-C are schematic cutaways of the safe and arm device in a safe position, a position with one lock removed and a fully armed position, respectively.

The safe and arm device 38 includes an electrical detonator 64, such as the M100, that receives the electrical fire signal from the first microprocessor 10. The explosive output of the electrical detonator 64 ignites an output charge 66, such as the M61 stab detonator, which then ignites the warhead in the projectile 42. FIG. 4 is a schematic cutaway of the safe and arm device 38 (SA) in the safe position and FIG. 7A is a cutaway side view of the SA 38 also in the safe position. The SA 38 includes a housing 50 with electrical contacts 68 for interfacing with the fuze electronics.

A rotor support 52 supports a rotor 54 (FIG. 7A) via rotor shaft 56. Rotor 54 may rotate with respect to rotor support 52 and is biased for rotation by a spring (not shown). The electrical detonator 64 is disposed in the housing 50 in a fixed position. The output charge 66 is disposed in the rotor 54 and moves with the rotor 54. In the unarmed position of FIGS. 4 and 7A, the electrical detonator 64 and output charge 66 are angularly displaced from one another by, for example, 90 degrees. As shown in FIGS. 4 and 7A, a known three leaf mechanism 58 holds rotor pin 62 in place in crescent shaped opening 60. At launch, setback acceleration causes three leaf mechanism 58 to function and release rotor pin 62 thereby allowing the rotor 54 to rotate a first amount, for example, twenty degrees. The three leaf mechanism 58 comprises the first SA lock. With the first lock removed, the SA 38 is in the position shown in FIGS. 6A and 7B.

Figure 5:
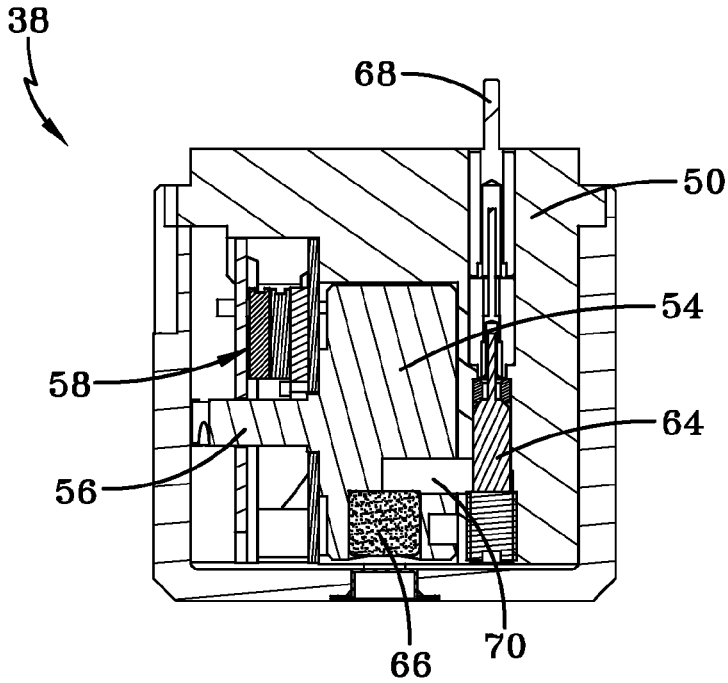
Figure 6B:
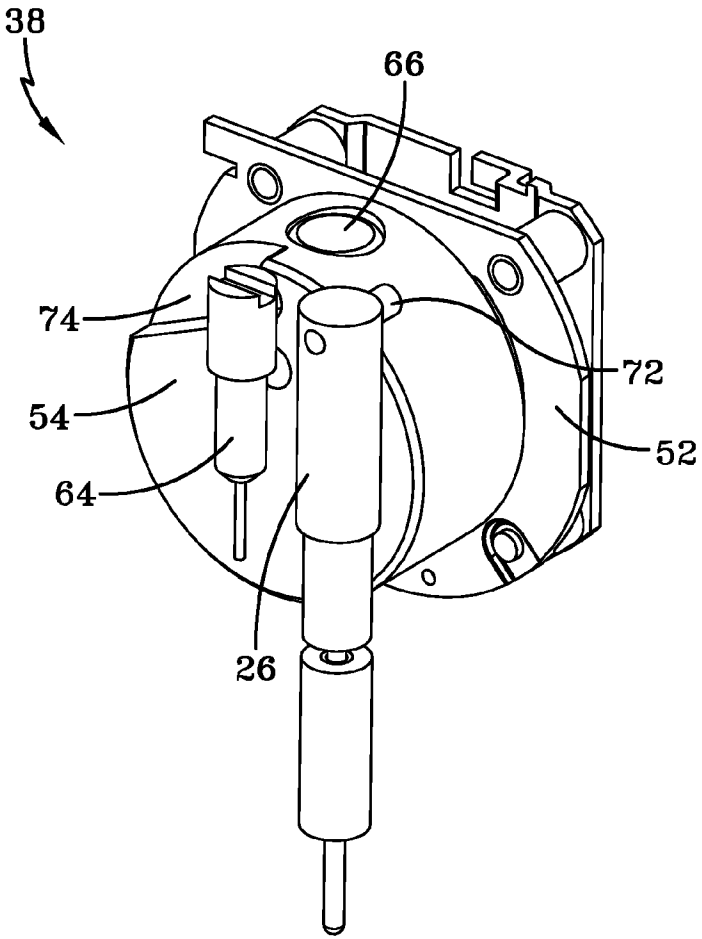
FIGS. 6A and 6B are schematic cutaways of the safe and arm device.
Figure 6A:
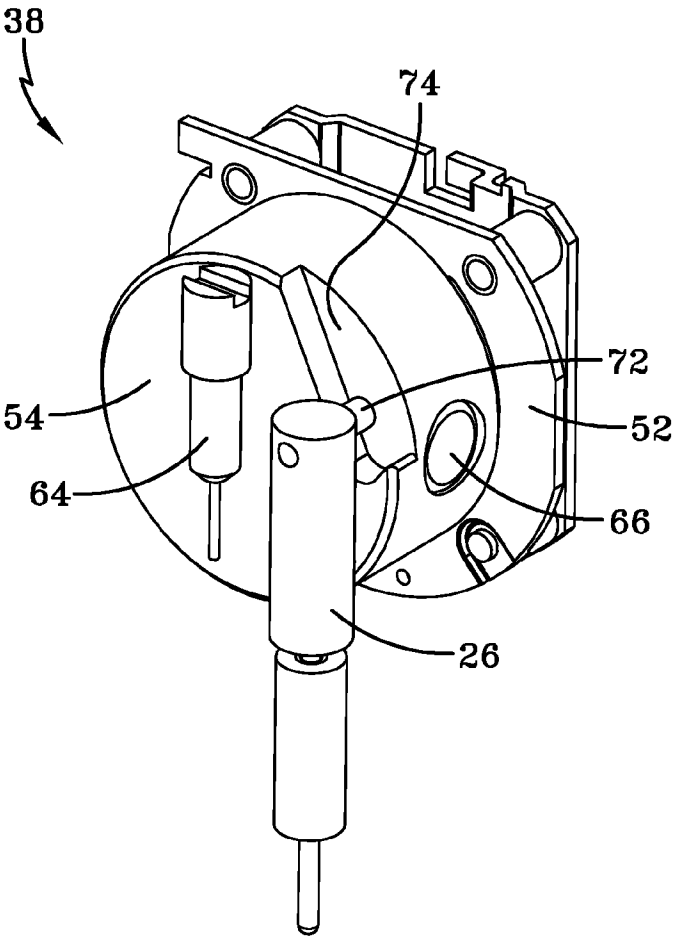
Figure 7B:
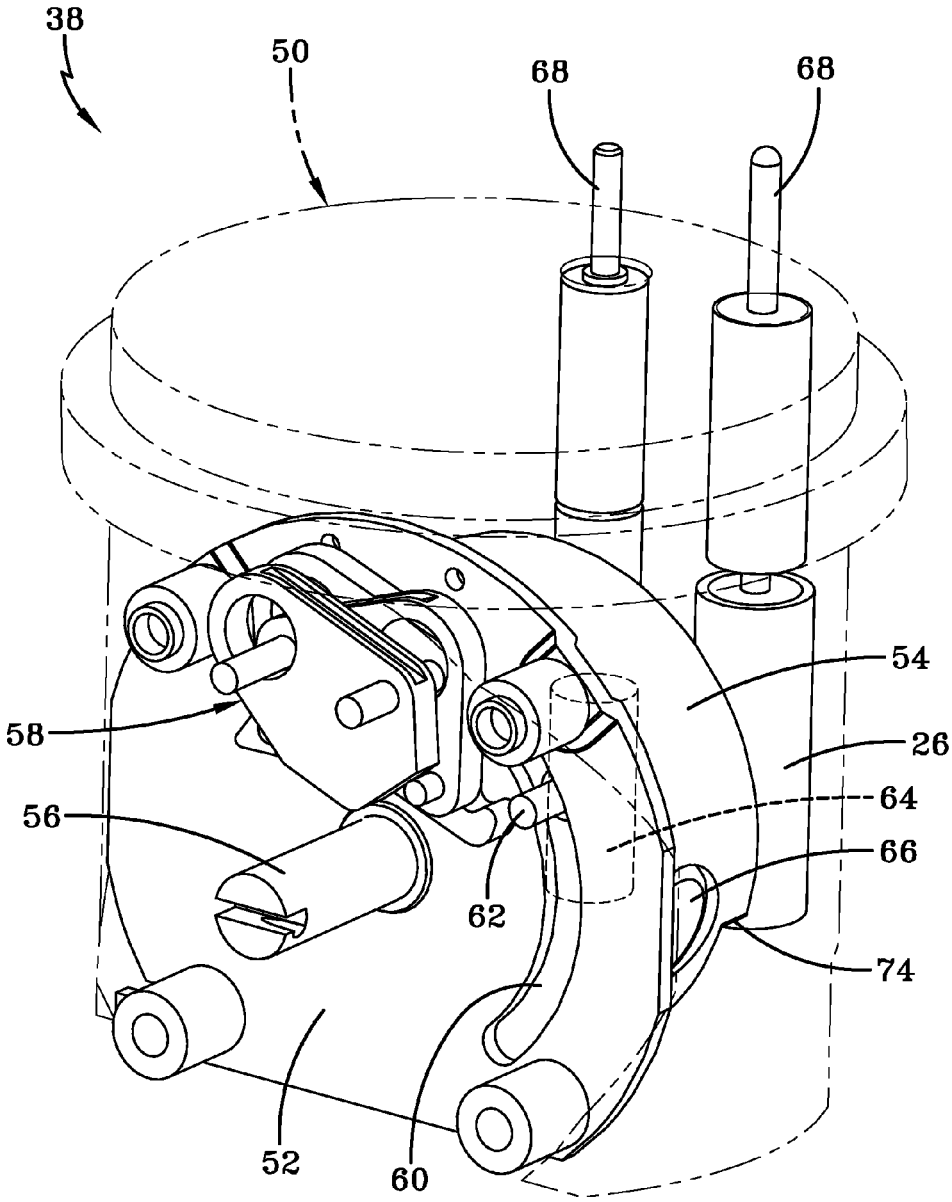
Figure 7C:
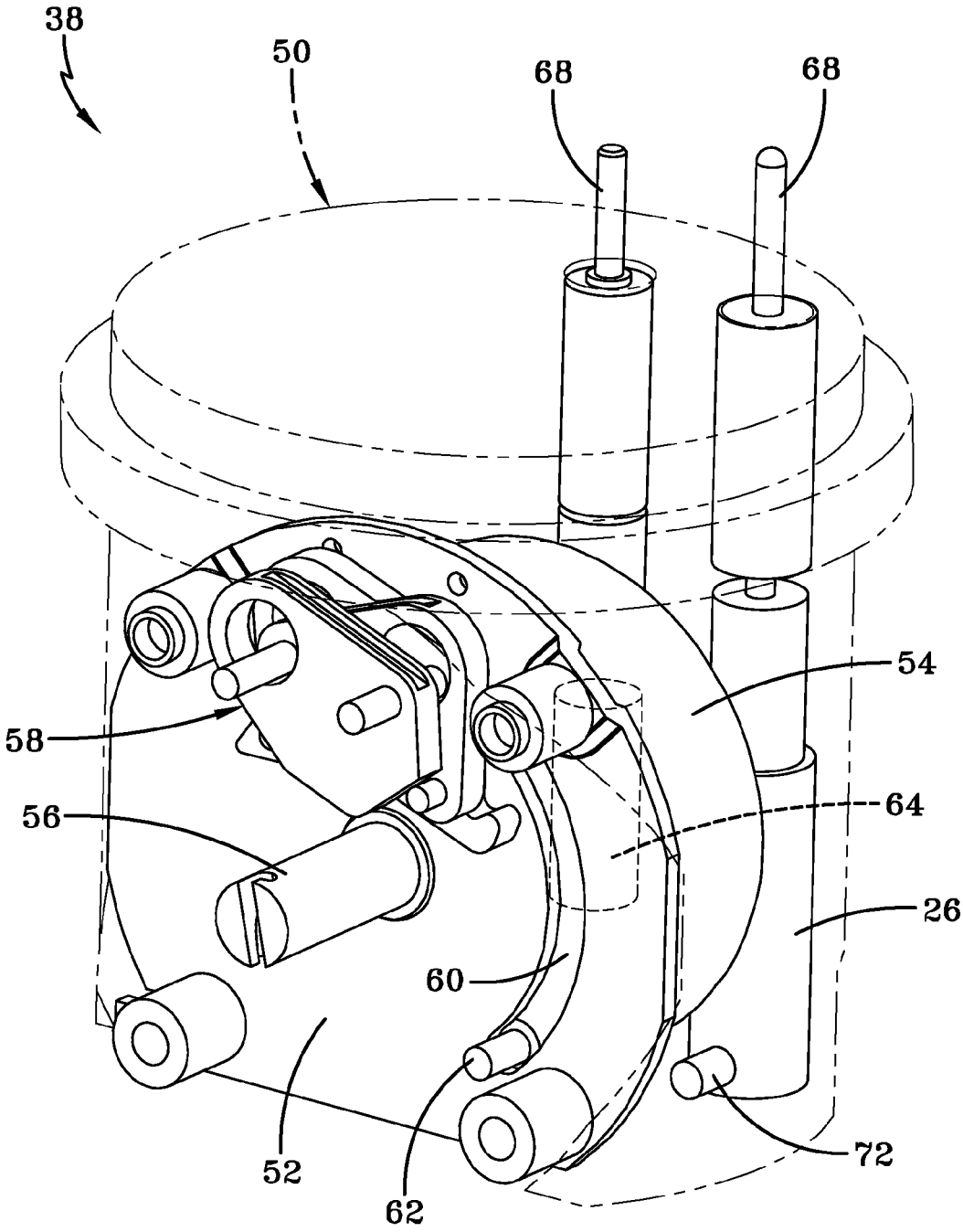

FIGS. 6A and 6B schematically show the piston actuator operation. FIG. 6A is before actuation and FIG. 6B is after actuation. At a predetermined time after launch, the first microprocessor 10 sends a signal to the SA 38 to activate the piston actuator 26. The piston actuator 26 is the second lock of the SA 38. The piston actuator 26 contains a small pyrotechnic charge that is ignited. Gas pressure from the burning pyrotechnic moves a piston/rod assembly. In the SA 38, the piston actuator 26 removes a locking pin 72 from a notch 74 in the spring loaded rotor 54, which allows the rotor 54 to further rotate. Compared to FIG. 6A, the angular position of the output charge 66 has moved counterclockwise. This second rotation of the rotor may be, for example, about 70 degrees. The second rotation of the rotor 54 places the output charge 66 adjacent the electric detonator 64 (FIGS. 5 and 7C). The SA 38 is now fully armed and awaiting a detonation signal from the multiplexer 40.

An advantage of the SA 38 is that the detonation of the output charge 66 is not dependent on electrical contact with the electric detonator 64. FIG. 5 is a schematic cutaway of the SA 38 in the armed position. Output charge 66 disposed in rotor 54 is now adjacent electric detonator 64. In prior devices, electrical contacts connected the detonator 64 to the output charge 66. The contacts on the output charge side moved with the rotor 54. During projectile deceleration, the electrical contacts were often not making a consistent connection, thereby increasing the probability of detonator 64 failing to ignite the output charge 66. In the SA 38, a channel 70 in the rotor 54 provides a route for the explosive output of detonator 64 to ignite the output charge 66. The SA 38 does not rely on moving electrical contacts to ignite the output charge 66.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A multi-mode fuze settable in the bore of a gun, comprising:

a first microprocessor is settable in a plurality of modes to initiate a fire signal, and a second microprocessor, the first microprocessor being connected to a resistor/capacitor (RC) clocked oscillator and the second microprocessor being connected to a quartz crystal clocked oscillator, the first and second microprocessors being connected to each other, the second microprocessor being operable to time calibrate the first microprocessor just prior to firing of the gun.

2. The fuze of claim 1 further comprising a safe and arm device connected to the first microprocessor; power storage capacitors connected to the first microprocessor; a multiplexer connected to the first microprocessor; a nose mounted impact switch connected to the multiplexer; at least one impact delay circuit connected to the first microprocessor and the multiplexer; and at least one acceleration switch connected to the first microprocessor.

3. The fuze of claim 2 wherein the safe and arm device comprises a piston actuator connected to the first microprocessor.

4. The fuze of claim 3 wherein the safe and arm device comprises two locks, a first lock being unlocked by setback acceleration and a second lock being unlocked by functioning of the piston actuator.

5. The fuze of claim 2 wherein the at least one impact delay circuit comprises a short impact delay circuit and a long impact delay circuit.

6. The fuze of claim 5 wherein the impact delay circuits comprise resistor/capacitor circuits.

7. The fuze of claim 2 wherein the multiplexer sends a fire signal to the safe and arm device.

8. The fuze of claim 2 wherein the first microprocessor is settable in a plurality of modes comprising an impact mode, an airburst mode and at least one impact delay mode.

9. The fuze of claim 8 wherein the airburst mode comprises setting an airburst time measured from time zero at launch.

10. The fuze of claim 9 wherein the time zero is determined by the at least one acceleration switch.

11. The fuze of claim 8 wherein the impact mode comprises closing one of the nose switch or at least one acceleration switch.

12. The fuze of claim 1 wherein the second microprocessor is turned off prior to launch.

13. The fuze of claim 1 further comprising a safe and arm device connected to the first microprocessor, the safe and arm device comprising an electric detonator and an output charge wherein, in an armed position, the electric detonator and the output charge are not electrically connected and further wherein the electric detonator energetically initiates the output charge.

14. The fuze of claim 13 wherein the safe and arm device further comprises a spring loaded rotor and an output charge disposed in the rotor, the rotor being operable to rotate with respect to the electric detonator.

15. The fuze of claim 14 wherein the first lock comprises a three leaf mechanism.

* * * * *